US009991634B2

(12) United States Patent
Kida

(10) Patent No.: US 9,991,634 B2
(45) Date of Patent: Jun. 5, 2018

(54) CONNECTOR

(71) Applicant: Sumitomo Wiring Systems, Ltd., Yokkaichi, Mie (JP)

(72) Inventor: Shinjiro Kida, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days. days.

(21) Appl. No.: 15/647,504

(22) Filed: Jul. 12, 2017

(65) Prior Publication Data

US 2018/0026389 A1 Jan. 25, 2018

(30) Foreign Application Priority Data

Jul. 25, 2016 (JP) ..... 2016-145146

(51) Int. Cl.
*H01R 13/629* (2006.01)
*H01R 13/453* (2006.01)
*H01R 13/03* (2006.01)

(52) U.S. Cl.
CPC ..... *H01R 13/62933* (2013.01); *H01R 13/03* (2013.01); *H01R 13/453* (2013.01); *H01R 13/62911* (2013.01); *H01R 13/62972* (2013.01); *H01R 13/6295* (2013.01)

(58) Field of Classification Search
CPC ..... H01R 13/62933
See application file for complete search history.

(56) References Cited

U.S. PATENT DOCUMENTS 5,830,006 A * 11/1998 Koumatsu ..... H01R 13/5213 439/449
5,873,737 A * 2/1999 Hashizawa ..... B60L 11/1818 439/310
2009/0209122 A1* 8/2009 Heggemann ..... H01R 9/2625 439/157
2011/0230071 A1* 9/2011 Shamoto ..... H01R 13/5213 439/157

FOREIGN PATENT DOCUMENTS

JP 2011-34923 2/2011

* cited by examiner

*Primary Examiner* — James Harvey
(74) *Attorney, Agent, or Firm* — Gerald E. Hespos; Michael J. Porco; Matthew T. Hespos

(57) ABSTRACT

A wire cover (70) is arranged to cover a rear surface of a housing (10) and includes a back plate (73) in a rear part. A pull-out port (77) for wires (30) is provided in an end part of the back plate (73) and an opening (74) is provided separately from the pull-out port (77). A U-shaped lever (90) is arranged to straddle the back plate (73) and connects the housing (10) and a mating housing at a connection position by being rotated with an operating portion (91) gripped. The operating portion (91) of the lever (90) enters the opening (74) at the connection position and is arranged in contact with or in proximity to an edge of the opening (74).

2 Claims, 9 Drawing Sheets

CONNECTOR

BACKGROUND

1. Field of the Invention

The invention relates to a connector.

2. Description of the Related Art

Japanese Unexamined Patent Publication No. 2011-34923 discloses a connector with a housing body. A plate-like one-piece rubber plug fits into a peripheral wall of the housing body and contacts the back surface of the housing body. A holder is locked to the housing body with the one-piece rubber plug sandwiched between the holder and the back surface of the housing body to restrict the detachment of the one-piece rubber plug. A wire cover is locked to the housing body to cover the rear surface of the holder, and a lever is supported rotatably on the wire cover.

The wire cover is box-shaped and one surface on both left and right sides perpendicular to the back surface of the housing body is open as a wire pull-out port. The lever is rotated such that an operating portion thereof extends along an outer side surface of a back plate part of the wire cover to connect the housings to each other at a connection position.

In the above case, the operating portion of the lever is located outside a side opposite to the pull-out port of the wire cover at the connection position and the operating portion and the side surface of the wire cover are arranged laterally side by side. Thus, the connector tends to be enlarged laterally. In contrast, if the side wall of the wire cover is cut to be open and the operating portion enters that opening, a lateral size can be reduced by a thickness of the side wall. However, if the side wall of the wire cover is cut, the strength of the wire cover may be reduced.

The invention was completed based on the above situation and aims to provide a connector capable of suppressing a strength reduction of a wire cover while avoiding enlargement.

SUMMARY

The invention is directed to a connector with a housing to be connected to a mating housing from the front. A wire extends from a rear surface of the housing. A wire cover covers the rear surface of the housing and includes a back plate in a rear part. A pull-out port for the wire is provided in an end part of the back plate, and an opening is provided separately from the pull-out port for the wire. A U-gate-shaped lever is arranged to straddle the back plate of the wire cover and is configured to connect the housing and the mating housing at a connection position by being rotated with an operating portion gripped. The operating portion of the lever enters the opening at the connection position and is in contact with or in proximity to an edge of the opening.

The wire cover includes the opening and the operating portion of the lever enters the opening at the connection position. Thus, the connector is not enlarged. The strength of the wire cover may be reduced by the opening. However, the operating portion of the lever is arranged in contact with or in proximity to the edge of the opening. Therefore the edge of the opening and the operating portion virtually are integrated and the wire cover remains strong.

The wire cover may be arranged along the back plate via a bent part from the rear surface of the housing and the opening may be open in a surface opposite to the pull-out port for the wire. According to this configuration, a wire accommodated state can be confirmed through the opening. Further, since the opening is arranged to correspond to the bent part of the wire on a side opposite to the pull-out port, the protrusion of the wire from the opening can be prevented.

DETAILED DESCRIPTION

Figure 1:
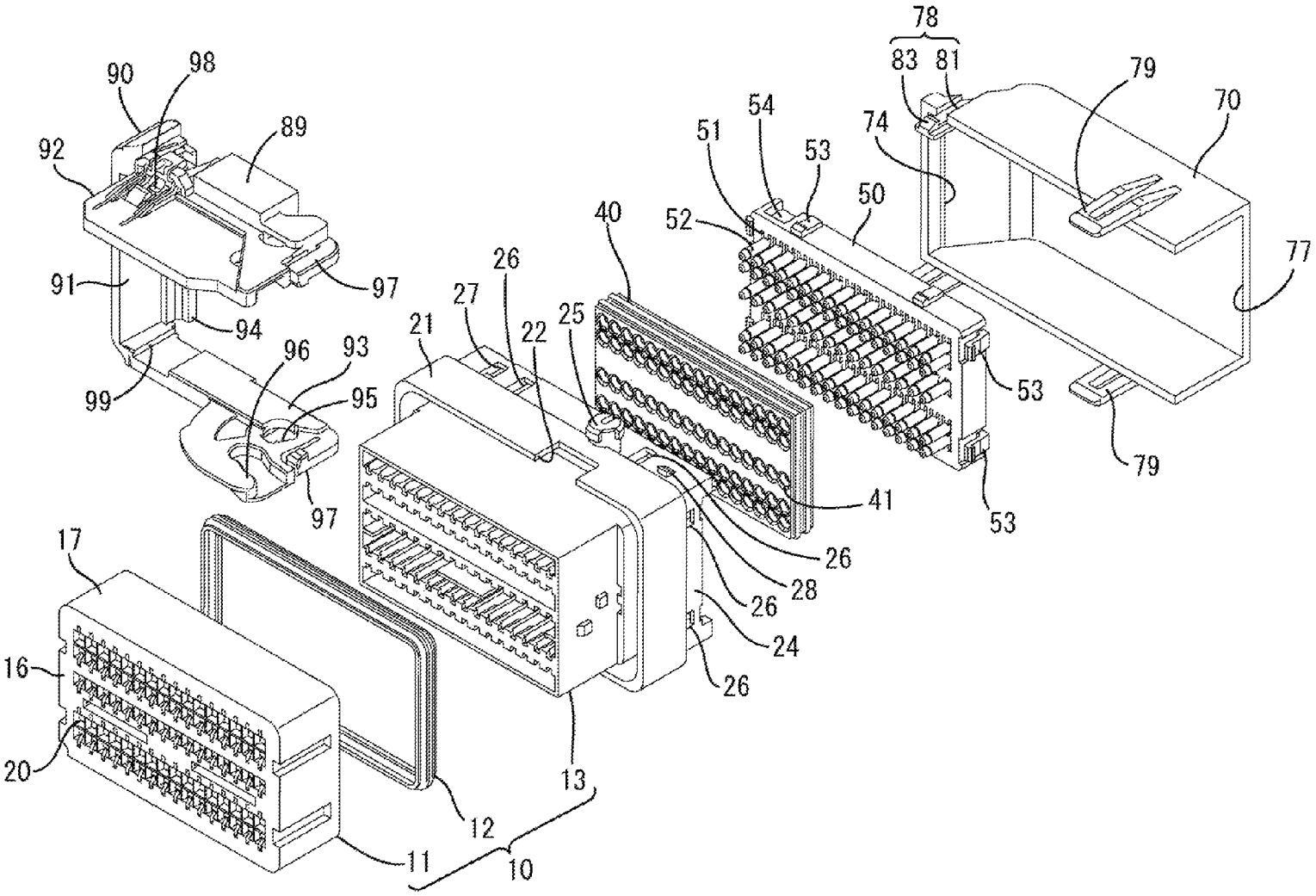
FIG. 1 is an exploded perspective view of a connector according to one embodiment of the present invention.

A connector according to one embodiment includes a front retainer 11, a seal ring 12, a housing body 13, a mat seal 40, a mat seal cover 50, a wire cover 70 and a lever 90 as shown in FIG. 1. The front retainer 11, the seal ring 12 and the housing body 13 constitute a housing 10, and the housing 10 is connectable to an unillustrated mating housing. Note that, in the following description, an end of the housing 10 to be connected to the mating housing is referred to as a front end concerning a front-rear direction and a vertical direction is based on each figure except FIG. 3.

Figure 5:
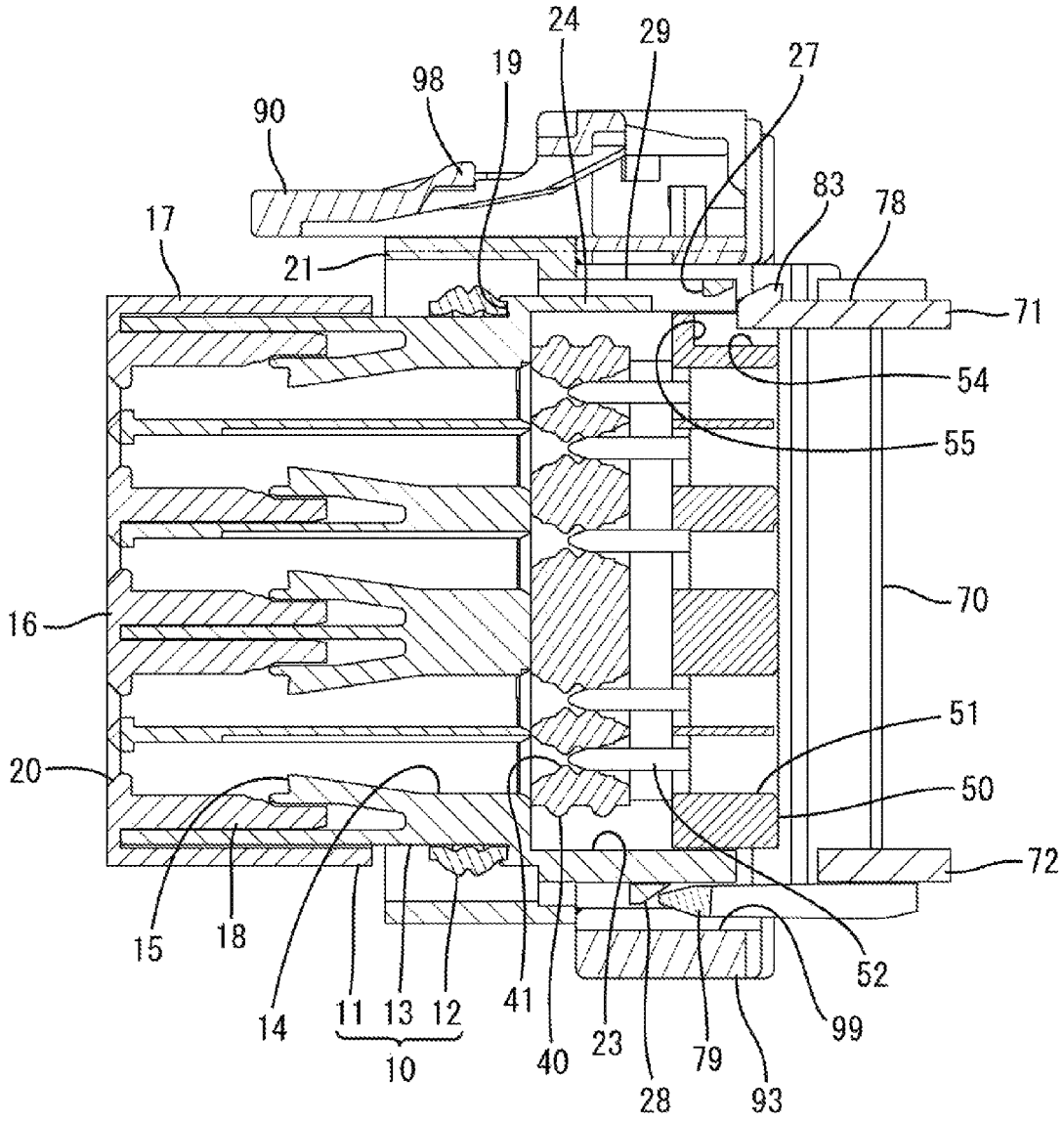
FIG. 5 is a section showing a state where a mat seal cover is in a semi-assembled state and a wire cover is moving to an assembled position.

The housing body 13 is made of synthetic resin and is substantially in the form of a rectangular block. As shown in FIG. 5, cavities 14 penetrate the housing body 13 in the front-rear direction. A locking lance 15 is cantilevered forward from an inner surface of each cavity 14. An unillustrated terminal fitting connected to an end part of a wire 30 (see FIG. 3) is inserted into each cavity 14 and is retained in the cavity 14 by the locking lance 15.

Figure 6:
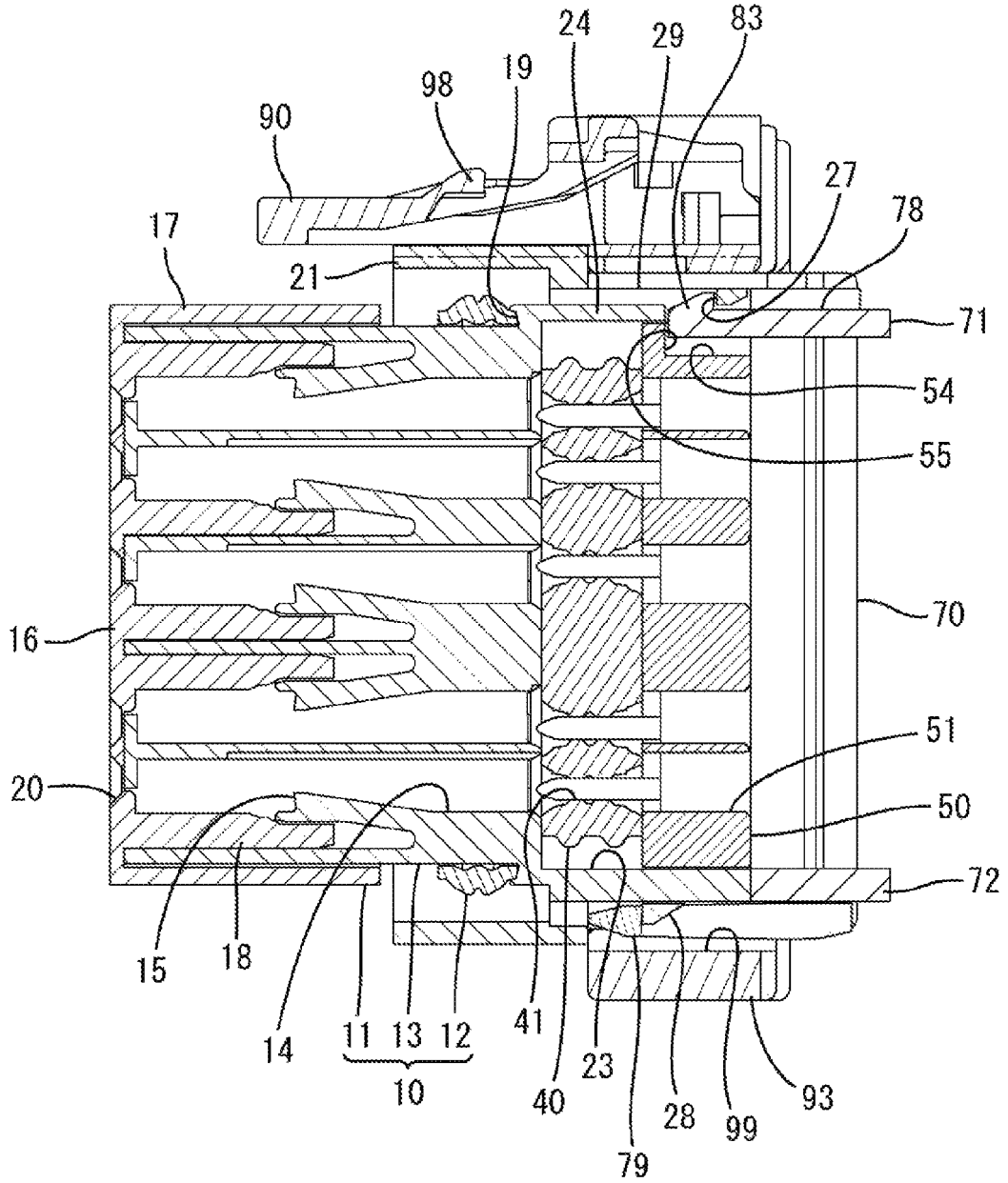
FIG. 6 is a section along A-A of FIG. 4.

The front retainer 11 is made of synthetic resin and includes a substantially flat plate-shaped front wall 16 extending substantially vertically and a peripheral wall 17 projecting rearward from the periphery of the front wall 16 to define a cap shape, as shown in FIG. 1. Restricting pieces 18 (see FIGS. 5 and 6) project rearward from the rear surface of the front wall 16. The front wall 16 has insertion holes 20 that receive tabs of unillustrated male terminal fittings mounted in the mating housing. The insertion holes 20 can communicate with the respective cavities 14. The front retainer 11 is mounted on the housing body 13 from the front. When the front retainer 11 is mounted properly, the front wall 16 faces the front surface of the housing body 13, the peripheral surface wall 17 covers the outer peripheral surface of the housing body 13 and each restricting piece 18 enters a deflection space for the corresponding locking lance 15 to restrict the deflection of the locking lance 15, as shown in FIG. 5.

The seal ring 12 is made of rubber and, as shown in FIG. 1 defines a substantially rectangular ring that is fit and held on the outer peripheral surface of the housing body 13. As shown in FIG. 5, the seal ring 12 contacts a step 19 on the outer periphery of the housing body 13 from behind and forward detachment is restricted by the peripheral wall 17 of the front retainer 11. When the housing 10 is connected to the mating housing, the seal ring 12 is sandwiched resiliently between a receptacle of the mating housing and the housing body 13 to provide sealing between the housings in a liquid-tight manner.

As shown in FIG. 1, a fitting tube wall 21 is provided on the outer peripheral surface of the housing body 13 and projects forward a short distance after standing up from a peripheral wall 24 of an accommodating recess 23. As shown in FIG. 5, the seal ring 12 is arranged inside the fitting tube wall 21 and the receptacle of the mating housing is insertable into a space between the fitting tube wall 21 and the seal ring 12. As shown in FIG. 1, the front end of the fitting tube wall 21 is cut at positions deviated from a lateral center to provide recesses 22.

The accommodating recess 23 is provided in the rear surface of the housing body 13, as shown in FIG. 5. The outer periphery of the accommodating recess 23 is defined by the peripheral wall 24 on a rear end part of the housing body 13. The peripheral wall 24 is thin and continuous over the entire periphery and has a substantially rectangular cross-section. Substantially cylindrical support shafts 25 project at positions deviated from lateral centers of upper and lower outer surfaces, as shown in FIG. 1.

As shown in FIG. 1, the peripheral wall 24 is provided with lock holes 26, a lock receiving portion 27 and outer lock receiving portions 28.

The lock holes 26 are substantially rectangular and penetrate left and right sides of upper and lower parts of the peripheral wall 24 and upper and lower sides of left and right parts of the peripheral wall 24.

The lock receiving portion 27 is rectangular and penetrates through one lateral side (side opposite to the side toward which the support shafts 25 are deviated) of the upper part of the peripheral wall 24. The lock receiving portion 27 is arranged laterally side by side with the adjacent lock hole 26 and has substantially the same shape substantially at the same position in the front-rear direction as the lock hole 26.

The respective outer lock receiving portions 28 form of claw-like projections and are provided on the other lateral sides of the upper part of the peripheral wall 24 and both left and right sides of the lower part of the peripheral wall 24. The outer lock receiving portion 28 provided on the upper wall is arranged at a position substantially symmetrical to the lock receiving portion 27 with respect to the lateral center of the upper wall part.

The mat seal 40 is a rubber plate having a substantially rectangular cross-section, as shown in FIG. 1, and is substantially perpendicular to the front-rear direction. The mat seal 40 is inserted into the accommodating recess 23 from behind and, as shown in FIG. 5, has the front surface resiliently held in close contact with the back surface of the accommodating recess 23 and the outer peripheral surface resiliently held in close contact with the inner peripheral surface of the accommodating recess 23. Substantially circular seal holes 41 penetrate the mat seal 40 at positions communicating with the respective cavities 14. The wire 30 connected to the terminal fitting (dummy plug 52 to be described later in the shown case) is inserted into each seal hole 41 so that the wire 30 (dummy plug 52) is sealed in a liquid-tight manner.

The mat seal cover 50 is made of synthetic resin and, as shown in FIG. 1, is a plate having a substantially rectangular cross-section and a slightly larger thickness in the front-rear direction than the mat seal 40. This mat seal cover 50 includes substantially rectangular through holes 51 at positions communicating with the respective seal holes 41. Each seal hole 41 is closed by the dummy plug 52 projecting forward. The corresponding dummy plug 52 is removed to open the through hole 51 so that the terminal fitting can be inserted into the cavity 14. In this way, the terminal fitting is insertable into the cavity 14 from the through hole 51 via the seal hole 41.

Resilient locks 53 are provided on the outer peripheral surface of the mat seal cover 50. The resilient locks 53 are cantilevered from the rear end to the front end of a body part (part where the through holes 51 are provided) on both left and right sides of upper and lower surfaces and both upper and lower sides of both left and right surfaces of the mat seal cover 50. This mat seal cover 50 is inserted into the accommodating recess 23 and holds the mat seal 40 in close contact by sandwiching the mat seal 40 between the front surface thereof and the back surface of the accommodating recess 23.

A cut 54 in the form of a substantially rectangular recess is provided on one lateral side of the upper surface of the mat seal cover 50, as shown in FIG. 1. The cut 54 is arranged laterally side by side with the adjacent resilient lock 53. Specifically, the cut 54 is a shallow recess defined by a bottom surface, left and right surfaces and a front surface, but is open at the top and rear. As shown in FIG. 5, the front surface of the cut 54 is arranged substantially vertically and laterally, and defines an assembling detection surface 55 with which the tip surface (front end surface) of a lock 78 to be described later can come into contact.

Figure 7:
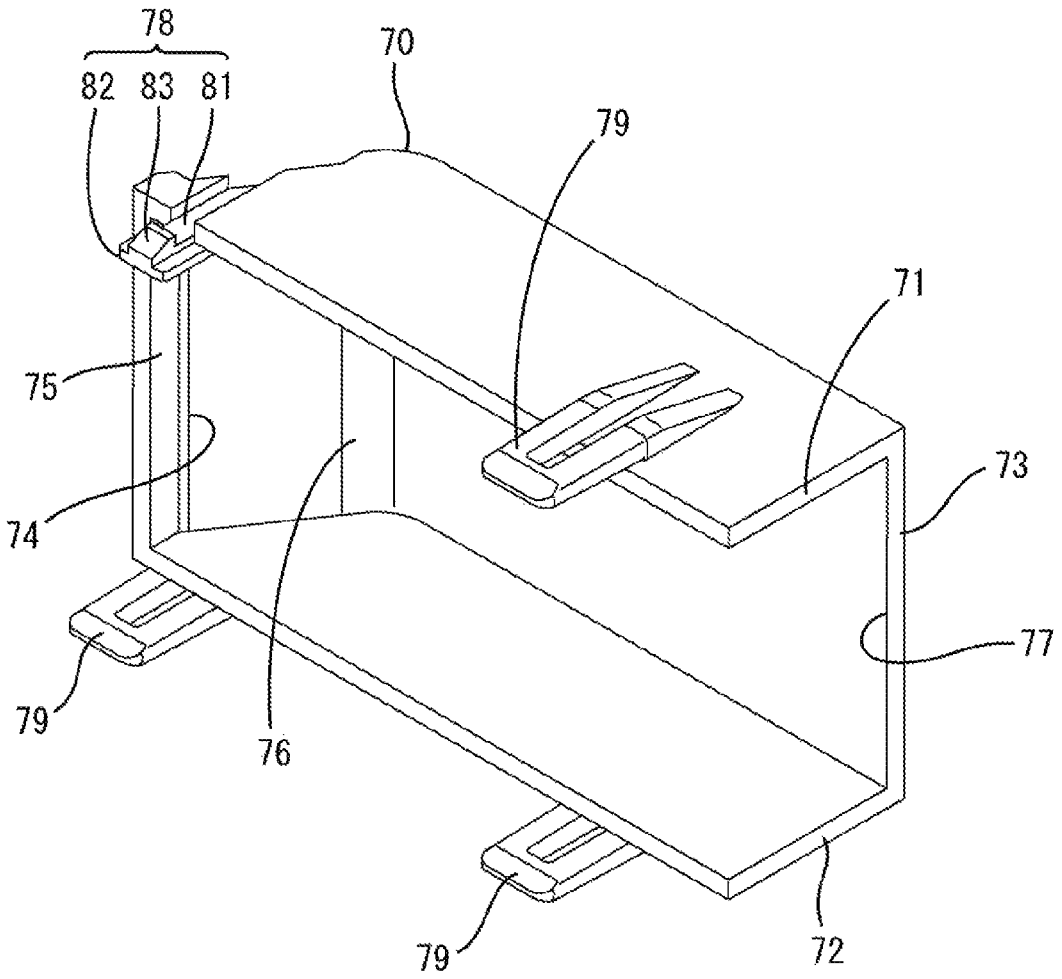
FIG. 7 is a perspective view of the wire cover.
Figure 8:
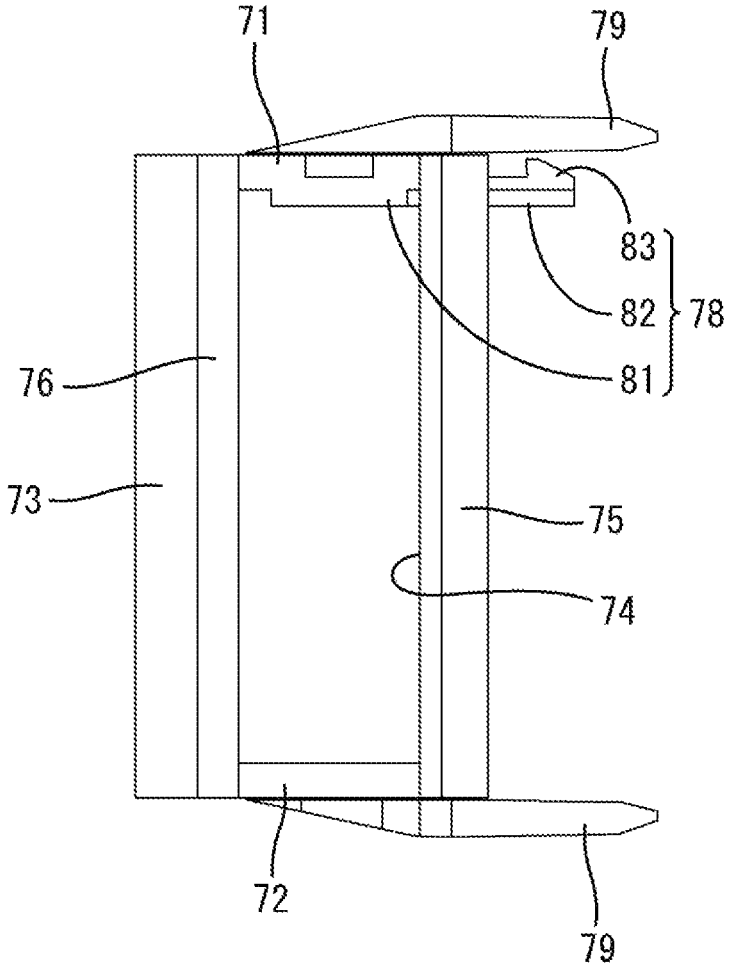
FIG. 8 is a side view of the wire cover.

The wire cover 70 is made of synthetic resin and, as shown in FIGS. 7 and 8, includes parallel upper and lower plates 71 and 72. A back plate 73 is arranged between the rear ends of the upper and lower plates 71 and 72 to close the rear surface. Front and rear bridges 75, 76 are arranged between one lateral end of each of the upper, lower and back plates, 71, 72, 73 to close one lateral end surface while leaving an opening 74 to be described later. An area of the wire cover 70 opposite the back plate 73 is open and an area opposite the bridges 75, 76 is open.

Although not shown in detail, each wire 30 (see FIG. 3) extends from the rear surface of the housing 10 and into the wire cover 70. Each wire then is bent forcibly toward the other lateral side by the back plate 73, is routed in the lateral direction along the back plate 73 and is pulled outside from an open pull-out port 77 in the other lateral end surface.

The opening 74 is substantially rectangular and extends between the side plates 75, 76 at a position opposite the pull-out port 77. The opening 74 is open over the entire height of the bridges 75, 76 and upper and lower ends are defined by the upper and lower plates 71 and 72. A presence of the wires 30 in the wire cover 70 can be confirmed visually though the opening 74.

The front bridge 75 defines the front end of the opening 74 and the rear bridge 76 defines the rear end of the opening 74. The front and rear bridges 75, 76 are long plates bridged between the upper and lower plates 71 and 72.

One lateral end part of each of the upper and lower plates 71 and 72 is cut by as much as a plate thickness of the side plate 75, 76 corresponding to the opening 74 in a plan view and a bottom view. The upper plate 71 has one lock 78 and the upper plate 71 and the lower plate 72 have plural outer locks 79.

Figure 3:
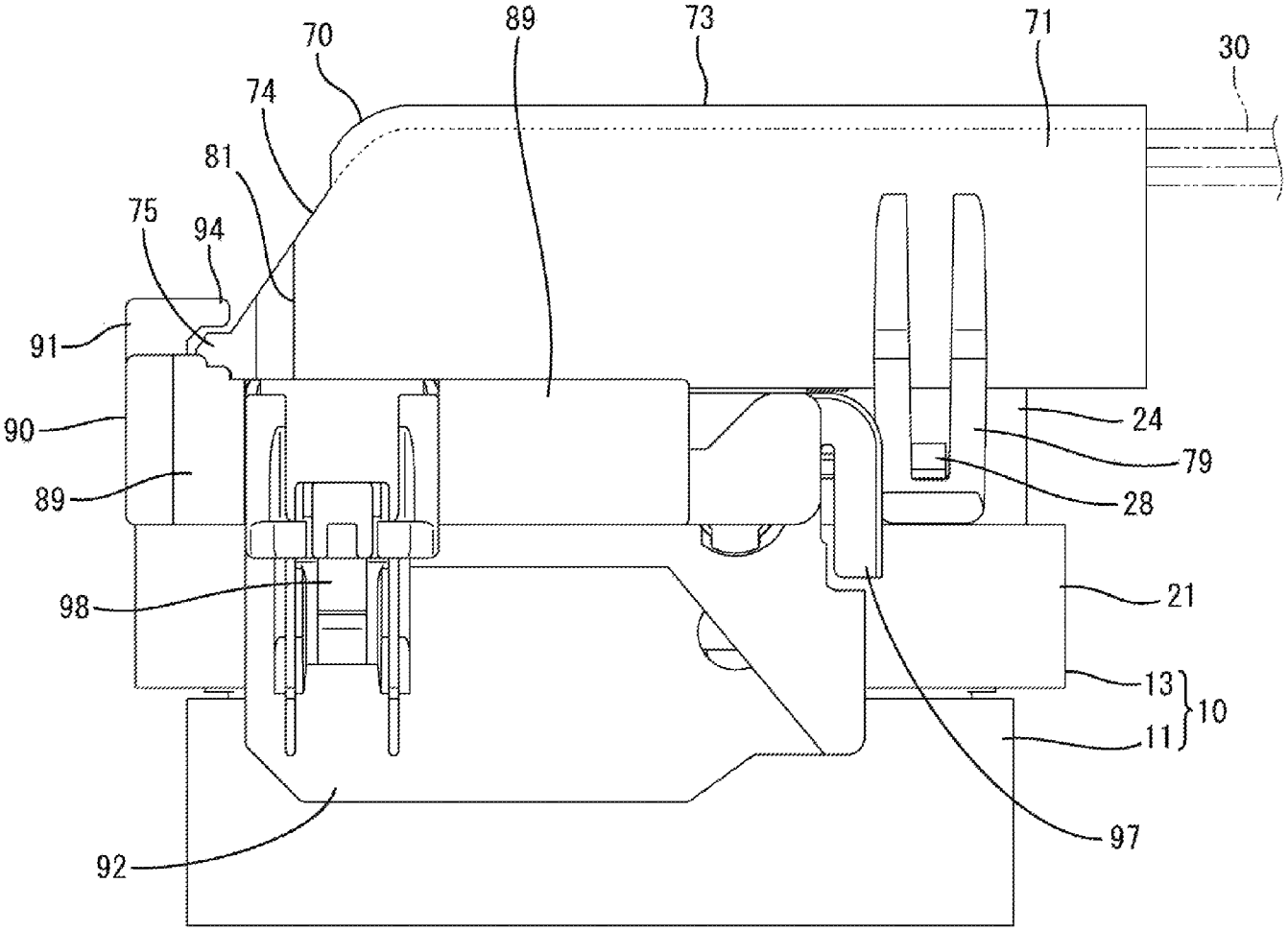
FIG. 3 is a plan view of the connector.
Figure 4:
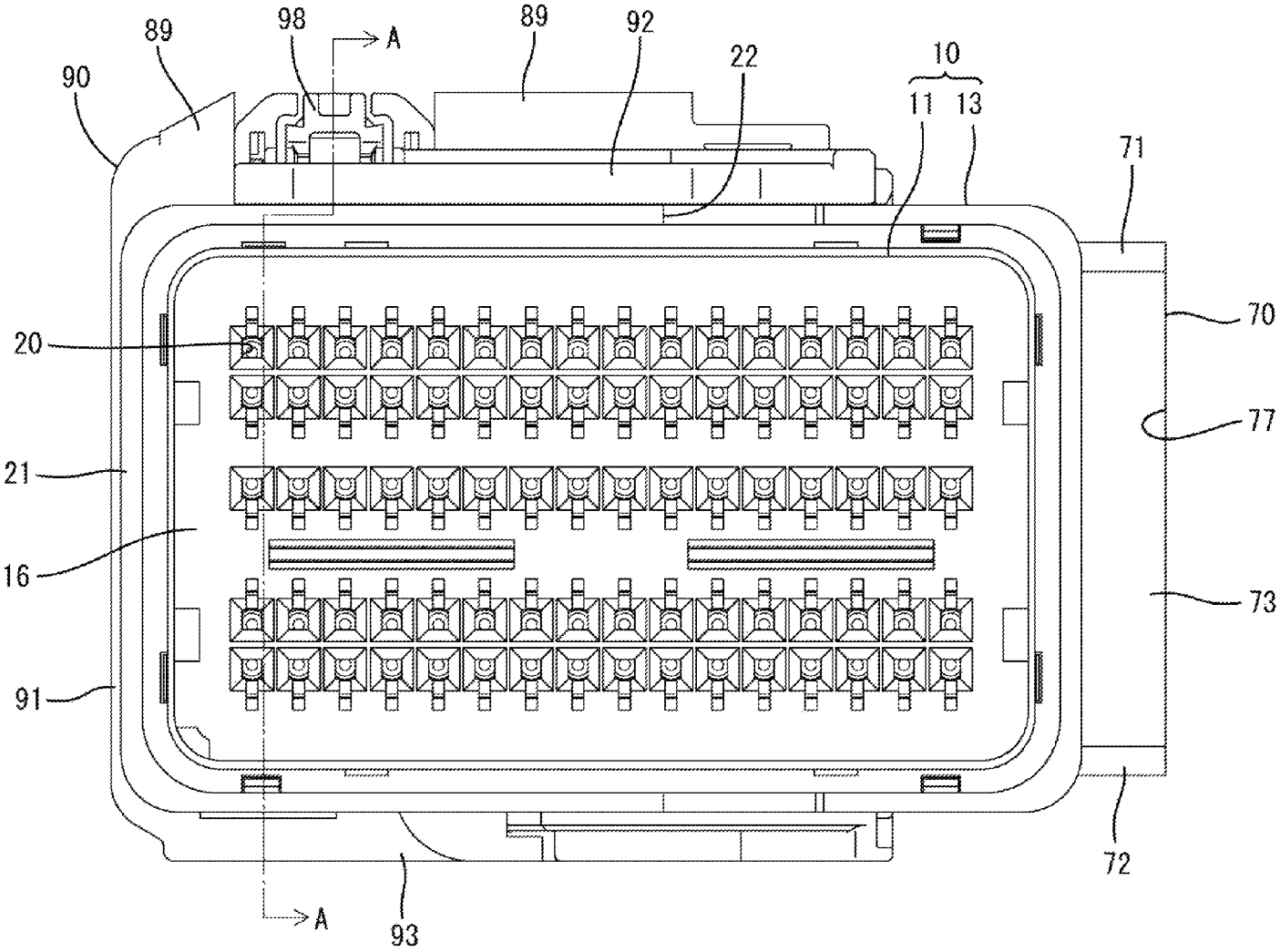
FIG. 4 is a front view of the connector.

As shown in FIG. 7, the lock 78 is on one lateral end of the upper plate 71 and has an inner step 81 extending in the front-rear direction while being retracted slightly inward to be stepped on that one lateral end part, a lock body 82 connected to the inner step 81 and projecting forward from the front end of the upper plate 71 and a claw-like lock projection 83 projecting out on a tip (front end part) of the lock body 82. As shown in FIG. 3, the upper end of the inner step 81 is connected to an inclined edge of the opening 74. An outward projecting dimension of the lock projection 83 is equal to or slightly smaller than an inwardly retracting amount of the inner step 81.

As shown in FIG. 7, the respective outer locks 79 are arranged on the other lateral side of the upper plate 71 and both left and right sides of the lower plate 72. The outer locks 79 extend substantially parallel to the front-rear direction on outer surface sides of the upper plate 71 and the lower plate 72. Each outer lock 79 has two ribs projecting forward from the front end of the upper plate 71 or the lower plate 72 and a coupling part bridged between the front ends of the ribs to define a U-shape. A part of the outer lock 79 between the front end of the upper plate 71 or the lower plate 72 and the coupling part is an opening having a rectangular cross-section.

The lock 78 and the respective outer locks 79 are deflectable and deformable in the vertical direction with the front end of the upper plate 71 or the lower plate 72 serving as a support. The wire cover 70 is mounted on the housing body 13 from behind.

Figure 9:
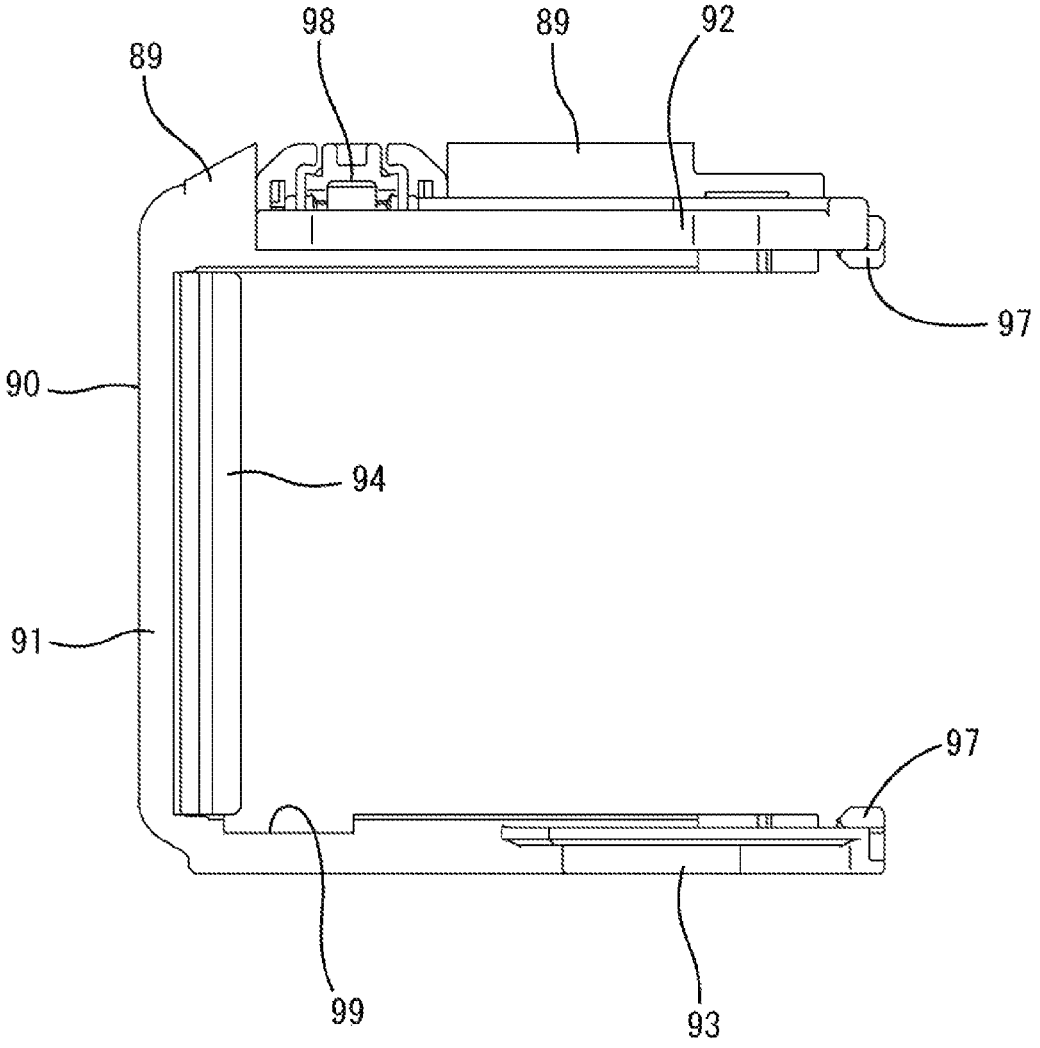
FIG. 9 is a front view of a lever.

The lever 90 is made of synthetic resin and, as shown in FIGS. 1 and 9, includes a substantially vertical operating portion 91 and substantially parallel upper and lower arms 92, 93 that project from upper and lower ends of the operating portion 91 to define a U-shape. The lever 90 is arranged to straddle the housing 10 and the wire cover 70 and is rotatable between an initial position where the operating portion 91 is behind the wire cover 70 and a connection position where the operating portion 91 is on one lateral side of the wire cover 70 and the housing body 13. Note that, in the following description on the lever 90, the front-rear direction and lateral direction are based on a state where the lever 90 is at the connection position (see FIGS. 2 to 6).

The operating portion 91 includes a projection 94 projecting in the same direction as the arms 92, 93 from the rear end of a body in the form of a flat plate. The projection 94 extends vertically along the rear end of the body and is gripped easily when rotating the lever 90.

As shown in FIG. 1, a substantially circular bearing portion penetrates through each of the arms 92, 93 and is fit and supported on the support shaft 25 of the housing body 13. A bottomed cam groove 96 is provided in the inner surface of each arm 92, 93, extends in a predetermined direction and is open on an outer peripheral edge. The lever 90 is arranged so that openings of the cam grooves 96 face forward at the initial position. Cam followers of the unillustrated mating housing are inserted into the cam grooves 96 when the housings are connected shallowly. Thereafter, the lever 90 is rotated about the support shafts 25 toward the connection position, and the cam followers slide on groove surfaces of the cam grooves 96 to exhibit a cam action and to cause the housings to reach a properly connected state at the connection position.

Two partial locking arms 97 are provided on the other lateral ends (sides away from the operating portion 91) of the arms 92, 93. The partial locking arms 97 are cantilevered forward and projection parts on front end parts are locked resiliently to the inner edges of the recesses 22 of the housing body 13 to hold the lever 90 in a partially locked state at the initial position.

The upper arm 92 has the one lateral end (side of the operating portion 91) having a larger dimension than the lower arm 93. A housing lock 98 is provided on the one lateral end side of the upper arm 92. The housing lock 98 is cantilevered rearward from the front end between a pair of left and right slits, and is deflectable and deformable in the vertical direction with the front end serving as a support. The housing lock 98 functions to hold the housings in the properly connected state by locking the mating housing.

Figure 2:
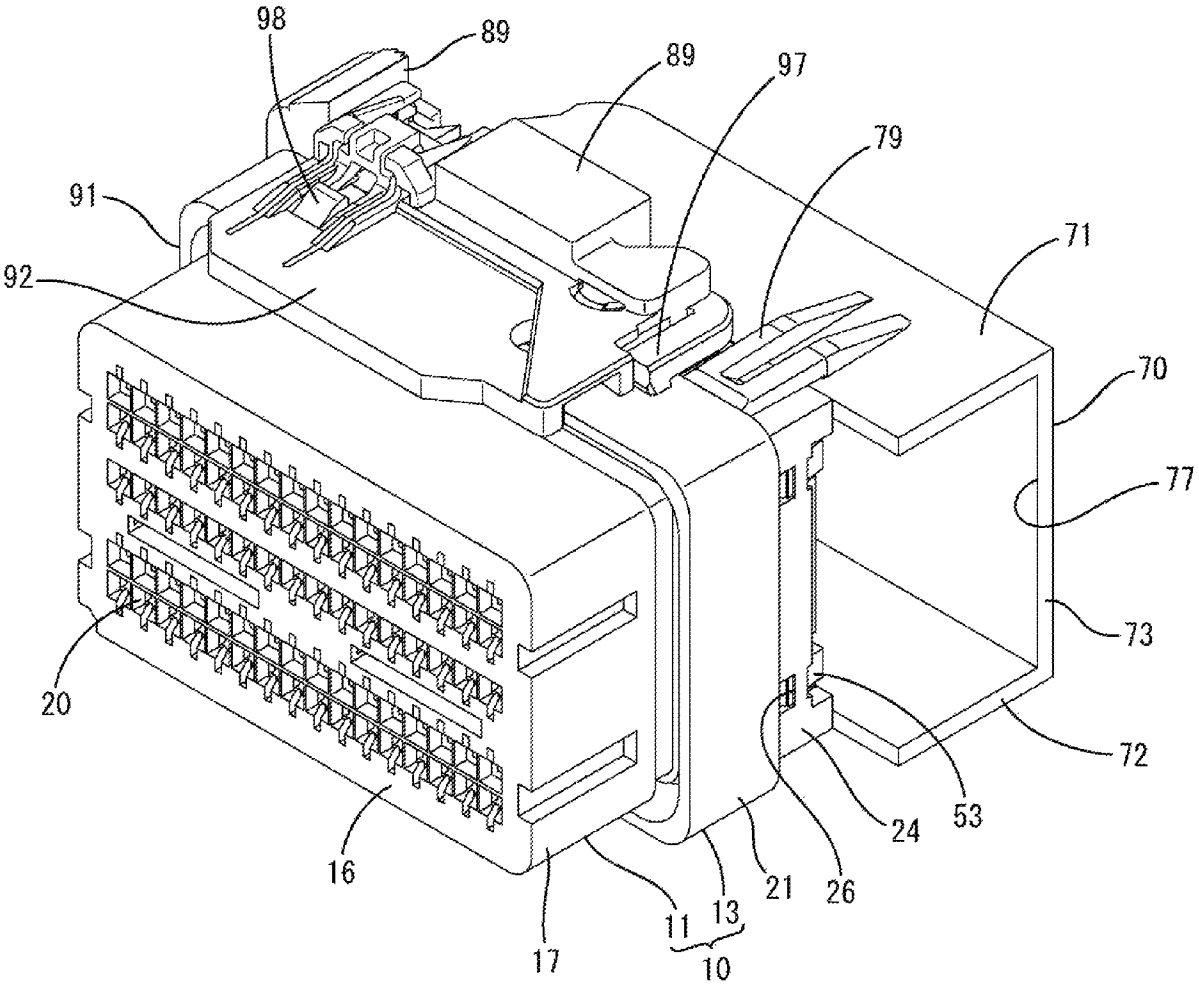
FIG. 2 is a perspective view of the connector.

As shown in FIGS. 2 and 3, the upper arm 92 is arranged to cover the upper surface of a rear part of the housing 10 including the fitting tube wall 21 except the other lateral side at the connection position. In this case, the one lateral side of the outer surface side of the upper part of the peripheral wall 24 defines a covered surface 29 (see FIG. 5) that is covered by the upper arm 92, and the lock receiving portion 27 is open in the covered surface 29. In contrast, the other lateral side of the upper part of the peripheral wall 24 is exposed without being covered by the upper arm 92 and the corresponding outer lock 79 is at a position not to interfere with the lever 90. Similarly, the outer lock 79 corresponding to the other lateral side of the lower part of the peripheral wall 24 also is arranged at a position not to interfere with the lever 90.

On the other hand, the one lateral side of the lower part of the peripheral wall 24 is covered by the lower arm 93. However, as shown in FIG. 5, the inner surface of the lower arm 93 is recessed to form an escaping recess 99, the outer lock receiving portion 28 is located inside the escaping recess 99 and a space for allowing the deflection of the outer lock 79 is ensured inside the escaping recess 99. Thus, the outer lock 79 is kept in a non-interfering state with the lever 90. Note that, as shown in FIG. 2, blocks 89 that are thicker than the lower arm 93 are provided at both left and right sides of the housing lock 98 on a rear end part of the upper arm 92.

To assemble the connector of this embodiment, the mat seal 40 is inserted into the accommodating recess 23 of the housing body 13 from behind, and then the mat seal cover 50 is inserted. When the mat seal cover 50 is assembled properly, each resilient lock 53 enters the inside of the accommodating recess 23 and a projecting part of a tip of each resilient lock 53 is inserted into the corresponding lock hole 26 from the inner surface side of the peripheral wall 24 of the accommodating recess 23 to be locked resiliently. As a result, the mat seal cover 50 is retained and held on the housing body 13.

The terminal fittings are inserted into the predetermined cavities 14 after the mat seal cover 50 is assembled with the housing body 13 (if the dummy plugs 52 are omitted). The wire cover 70 then is assembled with the housing body 13. When the wire cover 70 is properly assembled, each outer lock 79 is locked resiliently to the corresponding outer lock receiving portion 28 from the outer surface side of the peripheral wall 24 of the accommodating recess 23, and the lock body 82 of the lock 78 enters the cut portion 54 at the inner side of the accommodating recess 23. Additionally, the lock projection 83 of the lock 78 is inserted into the corresponding lock receiving portion 27 from the inner surface side of the peripheral wall 24 to be locked resiliently (see FIG. 6). In this way, the mat seal cover 50 is retained and held on the housing body 13. A locking structure by the lock 78 and the lock receiving portion 27 is realized in a part corresponding to the covered surface 29 of the peripheral wall 24 covered by the lever 90. Thus, reliability in holding the wire cover 70 on the housing body 13 can be improved.

When the wire cover 70 is assembled properly, the tip surface of the lock body 82 of the lock 78 is arranged faces and substantially contacts the assembling detection surface 55 of the cut portion 54. If the mat seal 40 is not assembled properly, i.e. if the tip parts of the resilient locks 53 are located behind the lock holes 26 and not inserted and locked to the lock holes 26 (see FIG. 5, hereinafter, referred to as a semi-assembled state), the tip surface of the lock body 82 inserted into the cut portion 54 faces into contact with the assembling detection surface 55 in an assembling process to restrict any further assembling of the wire cover 70 when it is attempted to assemble the wire cover 70 with the housing body 13. Thus, a user will know that the mat seal cover 50 is in the semi-assembled state if the assembling of the wire cover 70 is restricted. In this way, the rapidity of the assembling operation can be ensured by detecting the semi-assembled state of the mat seal cover 50 before the wire cover 70 is assembled properly.

The housing 10 is connected to the mating housing after the assembling is completed. At this time, the lever 90 is rotated about the support shafts 25 relative to the housing body 13 from the initial position to the connection position. In the process of rotating the lever 90, the operating portion 91 is displaced substantially along the outer surface side of the wire cover 70 from the back plate 73 to the rear bridge 76. When the lever 90 reaches the connection position, the projection 94 of the operating portion 91 enters the opening 74 and contacts an edge of the front bridge 75 defining the front end of the opening 74, as shown in FIG. 3. In this case, the projection 94 of the operating portion 91 may come close to the edge of the opening 74 without contact, but is arranged at a position where the projection 94 can contact the edge of the opening 74 when rattling occurs in a clearance range between the projecting portion 94 and the edge of the opening 74. Note that one lateral side of the front bridge 75 is arranged to be covered and contacted by the body of the operating portion 91. Further, when the lever 90 reaches the connection position, the finger of a worker gripping the projecting portion 94 of the operating portion 91 enters the opening 74 so that interference with the wire cover 70 is avoidable.

As described above, the following effects can be exhibited according to this embodiment.

When the lever 90 covers the outer surface of the peripheral wall 24 of the accommodating recess 23, the lock 78 is locked to the lock receiving portion 27 arranged at the position corresponding to the lever 90 from the inner surface side of the peripheral wall 24 of the accommodating recess 23. Thus, the interference of the lever 90 and the lock 78 is avoided.

The lock 78 can detect that the mat seal cover 50 is in the semi-assembled state by contacting the assembling detection surface 55 in the process of moving toward the lock receiving portion 27. Thus, the lock 78 has a locking function, and also a function of detecting the assembled state of the mat seal cover 50. Therefore the configuration can be simplified and usefulness can be enhanced.

Since the mat seal cover 50 has the cut portion 54 configured to allow the lock 78 to escape and the assembling detection surface 55 is formed on the back surface of the cut portion 54. Thus, interference of the lock 78 and the mat seal cover 50 are avoided reliably in the process of assembling the wire cover 70. Further, the cut portion 54 can have a function of allowing the lock 78 and also the function of detecting the assembled state of the mat seal cover 50.

The peripheral wall 24 of the accommodating recess 23 is provided with the outer lock receiving portions 28 at the positions where interference with the lever 90 is avoidable, and the wire cover 70 is provided with the outer locks 79 to be locked to the outer lock receiving portions 28 from the outer surface side of the peripheral wall 24 of the accommodating recess 23 on the side of the pull-out port 77 through which the wires 30 are pulled out. Thus, a degree of freedom in designing the outer locks 79 can be enhanced and the outer locks 79 can be provided with sufficient locking strength. As a result, even if large stress due to interference with the wires 30 is generated in the pull-out port 77 of the wire cover 70, the locked state of the outer locks 79 and the outer lock receiving portions 28 can be maintained satisfactorily.

Further, the wire cover 70 is provided with the opening 74, and the projection 94 of the operating 91 of the lever 90 enters the opening 74 at the connection position. Thus, the enlargement of the connector can be avoided by as much as an entered part of the projection 94. In this case, the strength of the wire cover 70 may be reduced by the opening 74, but the operating portion 91 of the lever 90 is arranged to contact the edge of the opening 74. Therefore, the edge of the opening 74 and the operating portion 91 virtually are integrated and a reduction in the strength of the wire cover 70 can be suppressed.

The wires 30 may be arranged along the back plate 73 via bent parts from the rear surface of the housing 10 and the opening 74 may be open in the surface opposite to the pull-out port 77. According to this configuration, the accommodated state of the wires 30 can be visually confirmed through the opening 74. Further, since the opening 74 is arranged to correspond to the bent parts of the wires 30 on the side opposite to the pull-out port 77, the protrusion of the wires 30 from the opening 74 can be prevented.

Other embodiments are briefly described below.

The lock receiving portion may be bottomed and may be formed by recessing the inner surface of the peripheral wall of the accommodating recess. Further, the lock receiving portion may project on the inner surface of the peripheral wall of the accommodating recess.

If the lock receiving portion projects on the inner surface of the peripheral wall of the accommodating recess, the lock may include a locking hole into which a projecting part of the lock receiving portion is to be inserted.

The entire operating portion of the lever may enter the inside of the opening.

The operating portion may constantly maintain a state in contact with the edge part of the opening at the connection position.

LIST OF REFERENCE SIGNS

10 . . . housing
13 . . . housing body
23 . . . accommodating recess
24 . . . peripheral wall
27 . . . lock receiving portion
28 . . . outer lock receiving portion
30 . . . wire
40 . . . mat seal
50 . . . mat seal cover
54 . . . cut portion
55 . . . assembling detection surface
70 . . . wire cover
73 . . . back plate
74 . . . opening
77 . . . pull-out port
78 . . . lock
79 . . . outer lock
90 . . . lever
91 . . . operating portion
94 . . . projection

What is claimed is:

1. A connector, comprising:

a housing with opposite front and rear ends and configured to be connected to a mating housing from the front, a wire extending from the rear end of the housing;

a wire cover arranged to cover the rear end of the housing and including a back plate in a rear part, a pull-out port for the wire being provided in an end part of the back plate, an opening being provided separately from the pull-out port for the wire; and a U-shaped lever arranged to straddle the back plate of the wire cover and configured to connect the housing and the mating housing at a connection position by being rotated with an operating portion gripped;

wherein the operating portion of the lever enters the opening at the connection position and is arranged in contact with or in proximity to an edge of the opening.

2. The connector of claim 1, wherein the wire cover is arranged along the back plate via a bent part from the rear end of the housing and the opening is open in a surface opposite to the pull-out port for the wire.

* * * * *